US007353812B1

(12) United States Patent
Gosdzinski et al.

(10) Patent No.: US 7,353,812 B1
(45) Date of Patent: Apr. 8, 2008

(54) VEHICLE ENGINE WITH INTEGRAL VACUUM GENERATOR

(75) Inventors: Keith Gosdzinski, Livonia, MI (US); Mark Wrobel, Birmingham, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/685,824

(22) Filed: Mar. 14, 2007

(51) Int. Cl.
*F02M 23/00* (2006.01)
*F02D 9/02* (2006.01)

(52) U.S. Cl. ..... 123/585; 123/339.23; 123/587

(58) Field of Classification Search ..... 123/73 AD, 123/339.23, 337, 184.21, 184.53, 184.54, 123/184.55, 184.56, 184.57, 585–587
See application file for complete search history.

(56) References Cited

U.S. PATENT DOCUMENTS 3,827,414 A * 8/1974 Sarto ..... 123/568.17
3,872,845 A * 3/1975 Schultz ..... 123/568.15
3,875,918 A * 4/1975 Loynd ..... 123/184.56
3,977,374 A * 8/1976 August ..... 123/458
4,231,337 A * 11/1980 Kuwahara et al. ..... 123/568.18
4,249,503 A * 2/1981 Noguchi et al. ..... 123/568.32
4,426,968 A * 1/1984 Onuki et al. ..... 123/339.18
4,430,982 A * 2/1984 Ramirez Diaz ..... 123/568.11
4,637,366 A * 1/1987 Cowles ..... 123/568.15
4,817,889 A 4/1989 Henry
4,895,125 A * 1/1990 Geiger ..... 123/568.11
5,108,266 A 4/1992 Hewitt
5,611,204 A * 3/1997 Radovanovic et al. ..... 60/605.2
6,041,754 A * 3/2000 Mori et al. ..... 123/339.23
RE37,090 E 3/2001 Kloosterman et al.
6,585,547 B2 * 7/2003 Tsubouchi et al. ..... 440/88 A
6,634,334 B1 * 10/2003 Hwang et al. ..... 123/339.23
6,655,392 B2 12/2003 Erwin et al.
6,739,313 B2 * 5/2004 Watanabe ..... 123/339.23
6,843,224 B2 * 1/2005 Ha ..... 123/337
6,883,506 B2 * 4/2005 Shin ..... 123/585
6,951,199 B2 * 10/2005 Suzuki ..... 123/339.11
7,076,952 B1 * 7/2006 Vetrovec ..... 60/605.1
7,174,883 B2 * 2/2007 Sonoda et al. ..... 123/586
2001/0007250 A1 * 7/2001 Hattori et al. ..... 123/339.1
2006/0016477 A1 1/2006 Zaparackas

FOREIGN PATENT DOCUMENTS

KR 1020030033157 A 5/2003

* cited by examiner

*Primary Examiner*—Hai Huynh
(74) *Attorney, Agent, or Firm*—Diana Brehob; Dickinson Wright PLLC

(57) ABSTRACT

An integral vacuum generator system for an internal combustion engine includes a throttle body and intake manifold defining a bypass passage which is connected with a vacuum manifold by both a venturi and a direct vacuum supply passage. Vacuum flow through the venturi and the direct vacuum supply passage are controlled by check valves.

4 Claims, 3 Drawing Sheets

VEHICLE ENGINE WITH INTEGRAL VACUUM GENERATOR

BACKGROUND OF THE INVENTION

1. Field of the Invention

The present invention relates to an integral vacuum generator system for an internal combustion engine in which the vacuum generator is integrated with an air induction throttle body and intake manifold.

2. Disclosure Information

Vehicles having vacuum operated brake boosters require a significant vacuum signal to provide the desired pedal assist. Under some operating conditions, and with certain engines, engine vacuum may be insufficient to meet the required level of brake boost without a vacuum enhancer or external vacuum source. US Patent Publication 2006/0016477 A1, which is assigned to the assignee of the present invention, discloses a vacuum enhancing check valve which is intended to provide additional vacuum with a unit which is mounted externally of a brake booster. The system shown in the '477 publication presents a potential issue, concerning packaging space, in crowded engine compartments. Other known types of vacuum intensifiers are positioned between an automotive brake booster and an internal combustion engine intake. Such intensifiers are connected with hoses to the brake booster and intake. Such devices however, suffer from increased vacuum leak paths, which are troublesome to diagnose and correct.

It would be desirable to provide an integral vacuum generator for a vehicular engine which is packaged efficiently upon the engine by integrating the vacuum generator with existing engine hardware, while simultaneously minimizing the number of potential vacuum leak paths.

SUMMARY OF THE INVENTION

According to an aspect of the present invention, an internal combustion engine includes an intake manifold and a throttle body having a main passage connected with the intake manifold. The throttle body has a throttle plate for controlling airflow through the main passage and the intake manifold. A bypass passage has a first portion formed in the throttle body, and a second portion formed integrally with the intake manifold. A venturi formed in the second portion of the bypass passage has a vacuum passage extending into a vacuum manifold. A direct vacuum supply passage extends from the second portion of the bypass passage into the vacuum manifold. According to another aspect of the present invention, a first check valve is positioned in a valve chamber formed in the venturi vacuum passage between the venturi and the vacuum manifold, and a second check valve is positioned in a valve chamber formed in the direct vacuum supply passage between the second portion of the bypass passage and the vacuum manifold.

According to another aspect of the present invention, the intake manifold and the bypass passage are preferably molded integrally into a first assembly, and the vacuum manifold, the venturi vacuum passage, and the direct vacuum supply passage are molded integrally as a second assembly, with the first and second assemblies being joined after molding.

It is an advantage of a system according to the present invention that the potential for vacuum leaks is greatly mitigated, as compared with known vacuum intensifier devices.

It is another advantage of a system according to the present invention that the present integral vacuum generator requires very little package space within the underhood environment of a vehicle.

Other advantages, as well as features of the present invention, will become apparent to the reader of this specification.

DETAILED DESCRIPTION OF THE PREFERRED EMBODIMENTS

Figure 1:
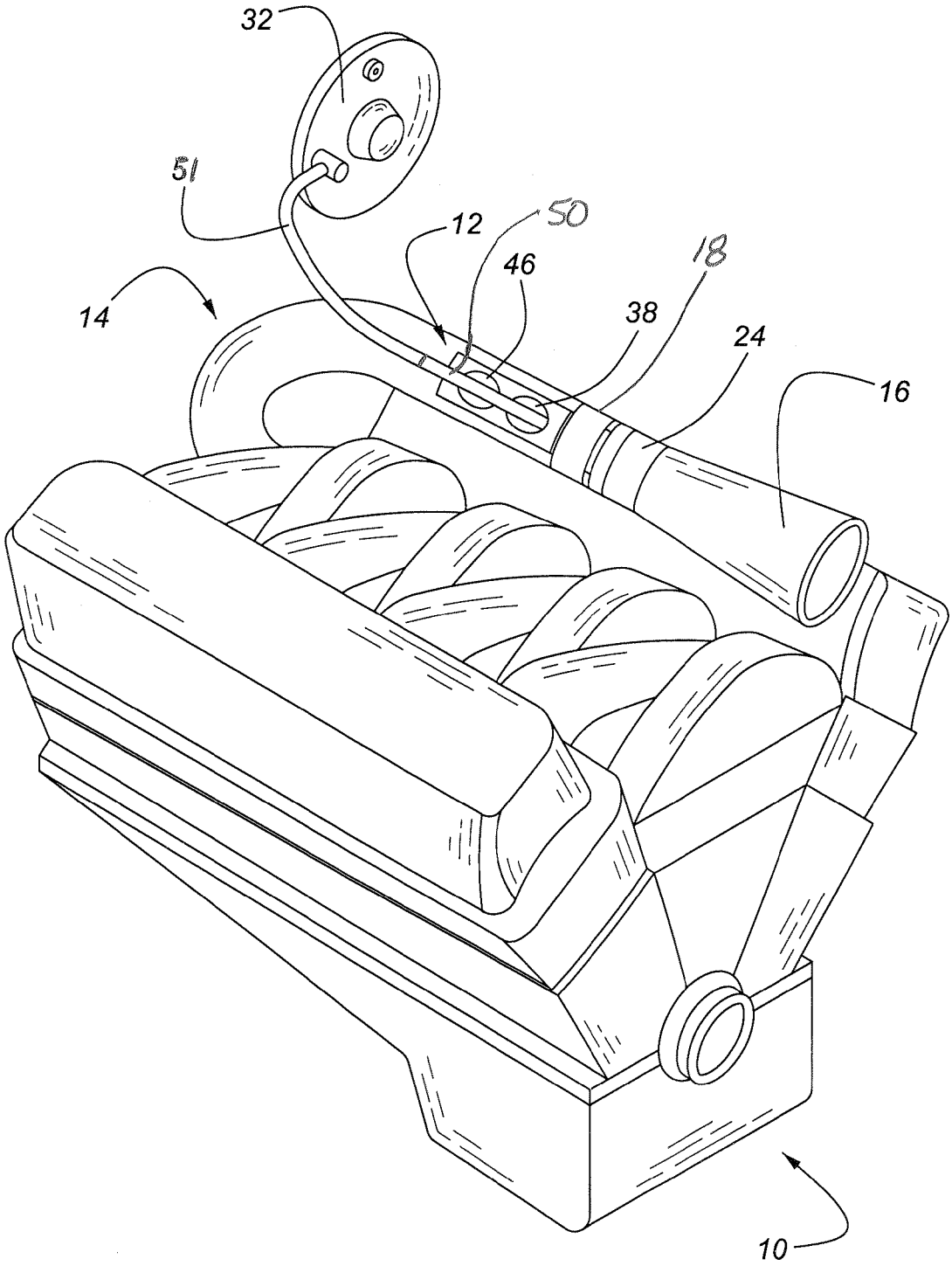
FIG. 1 is a schematic representation of a vehicular internal combustion engine having an integral vacuum generator system according to the present invention.

As shown in FIG. 1, according to an aspect of the present invention, engine 10 has an integral vacuum generator system, 12, which is mounted to intake manifold 14 and throttle body 18. Throttle body 18 is also connected with airflow meter 24 and air cleaner, 16. FIG. 1 also shows integral vacuum generator system 12 as being connected with brake booster 32 by hose 51.

Figure 2:
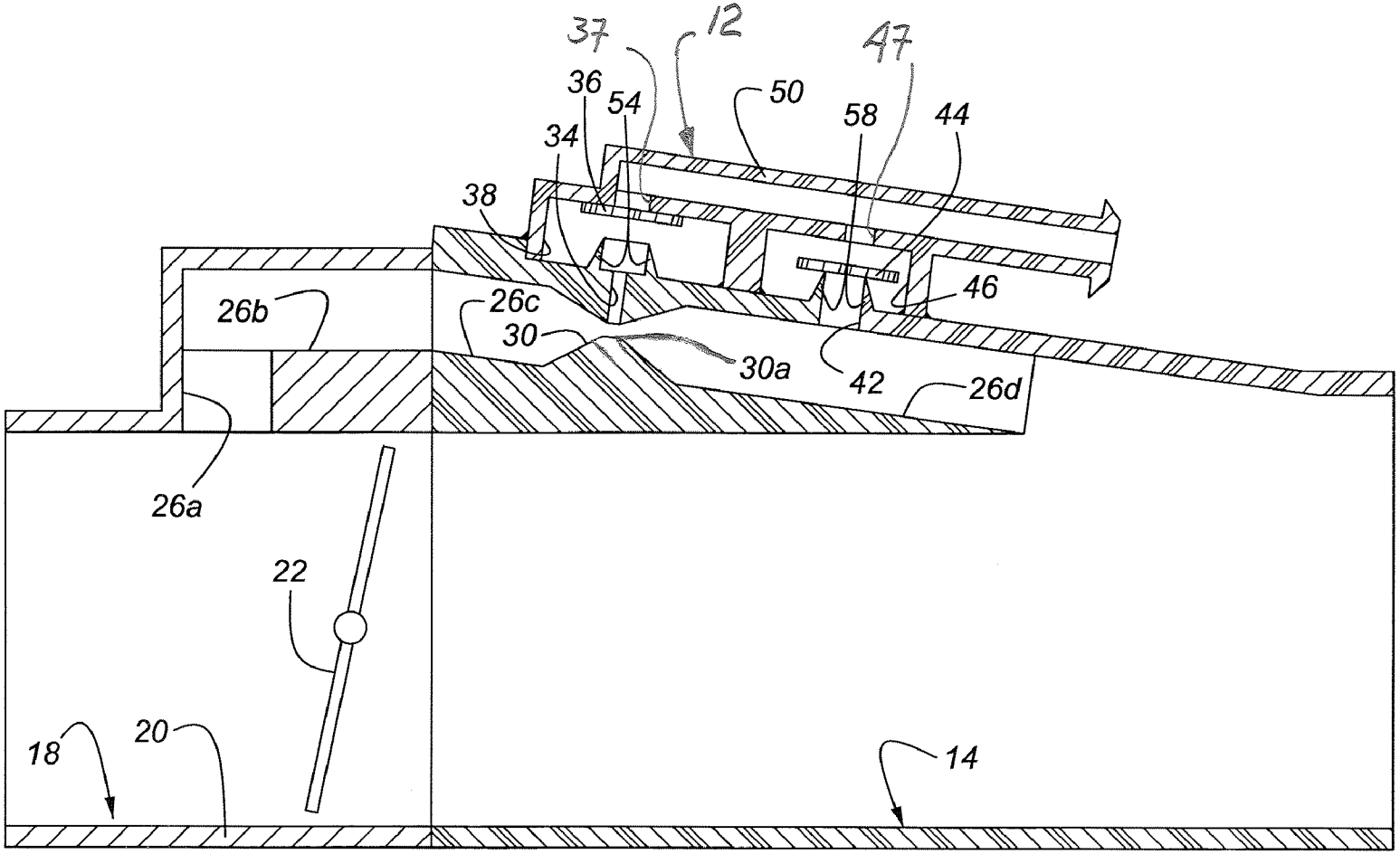
FIG. 2 is a cutaway of the present integral vacuum generator, shown in a closed throttle operating mode.
Figure 3:
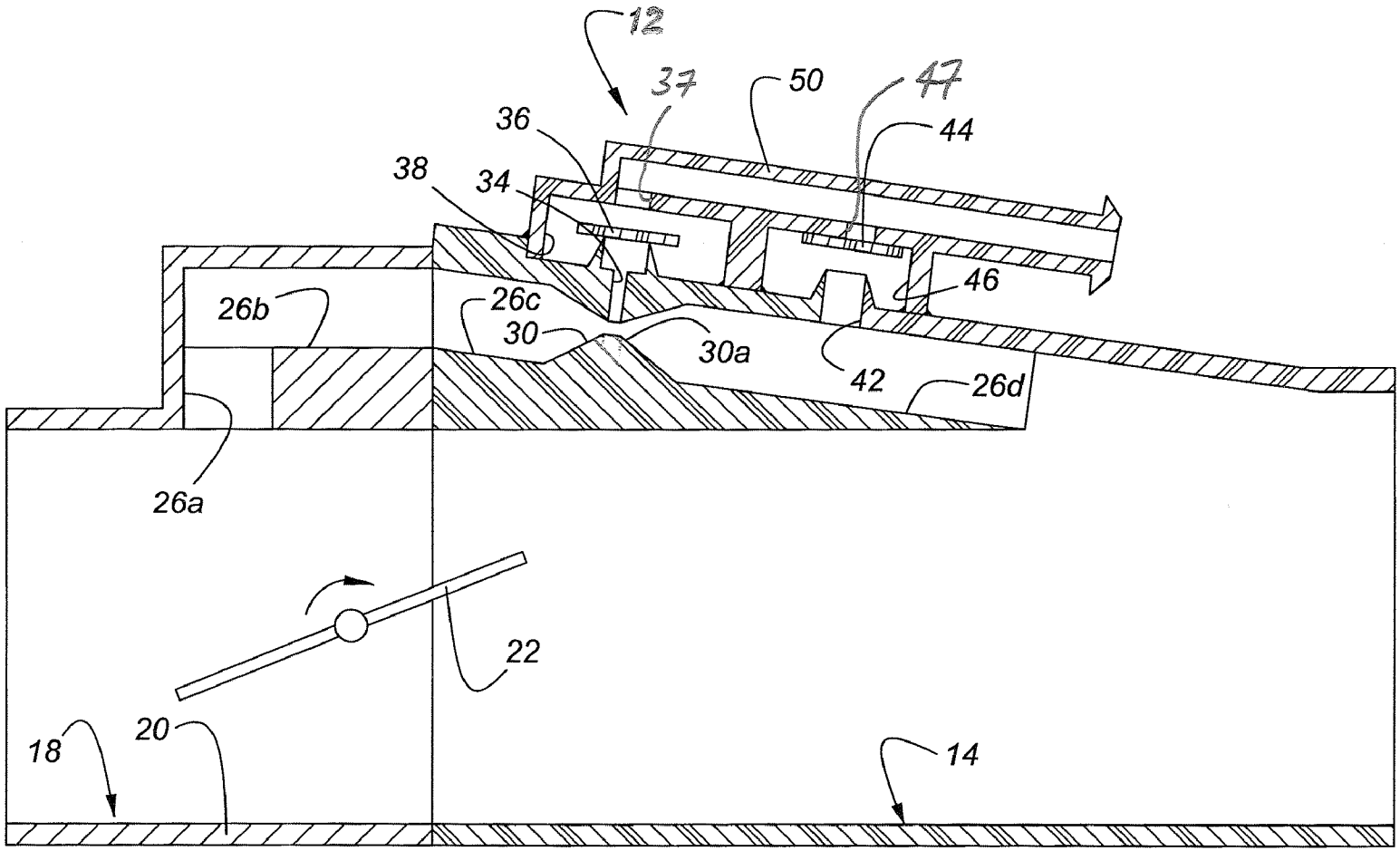
FIG. 3 is similar to FIG. 2, but shows the present integral vacuum generator system operating in an open throttle mode.

FIGS. 2 and 3 illustrate various component parts and passages of integral vacuum generator 12. Throttle body 18 has a main passage, 20; airflow through passage 20 is controlled by rotatable throttle plate 22. Throttle body 18 is bolted or otherwise attached to intake manifold 14. Note from FIG. 1 that mass air meter 24 is interposed between air cleaner 16 and throttle body 18 such that all of the air flowing into engine 10 passes through the mass air meter 24, so as to allow precise control of the air-fuel ratio of engine 10, regardless of the division of airflow between the various passages defining the current vacuum generator system.

As further shown in FIGS. 2 and 3, throttle body 18 has a bypass passage, with a first portion including a radially extending passage, 26*a*, which transforms into an axial segment, 26*b*, which is itself in communication with a second portion, 26*c*, formed integrally with intake manifold 14. Venturi 30 is formed in second portion 26*c* of bypass passage 26. Venturi 30 has a throat, 30*a*, with a vacuum passage, 34, extending radially therefrom. Passage 34 communicates the vacuum generated by venturi 30 with a valve chamber, 38, which allows the vacuum to be communicated to a vacuum manifold, 50. Check valve disc 36 is positioned within valve chamber 38. The function of valve disc 36 will be explained below.

Direct vacuum supply passage 42 extends radially into valve chamber 46, which is occupied in part by check valve disc 44, which controls flow from vacuum manifold 50 into passage 42.

Valve discs 36 and 44 are not spring loaded. Rather, the discs float in their respective valve chambers and when not adhering to the portions of the chambers adjoining vacuum manifold 50, remain poised upon serrated pedestals 54 and 58. These pedestals allow airflow past valve discs 36 and 44, respectively, when the discs are positioned upon their individual pedestals.

When the present integral vacuum generator is being operated with throttle plate 22 in the closed position of FIG. 2, the vacuum within intake manifold 14 is at a higher level, which is communicated through direct passage 42 to valve chamber 46. Thus, valve disc 44 will be open, allowing airflow from a brake booster or other vacuum-consuming device, such as booster 32 of FIG. 1, to enter engine 10. In other words, a high level of vacuum will be present within vacuum manifold 50. This vacuum signal will cause valve discs 36 and 44 to be in the locations shown in FIG. 2, and vacuum will be furnished to booster 32. In the operational mode of FIG. 2, disc 36 is seated against port 37, which prevents vacuum flow into valve chamber 38.

In the configuration of FIG. 3, throttle plate 22 is open, and vacuum within intake manifold 14 is accordingly less. However, airflow through engine 10 is higher when the throttle plate 22 is open and engine 10 has accelerated, and air flowing through venturi 30 produces a usable vacuum signal at throat 30*a* which is communicated by means of vacuum passage 34 and valve chamber 38 to vacuum manifold 50. The vacuum signal which opens valve disc 36 will be communicated by manifold 50 to valve disc 44 by means of port 47, thereby causing valve disc 44 to be positioned in a sealing position with respect to port 47. Taken together, these check valve positions allow vacuum to build within booster 32.

In a preferred embodiment, intake manifold 14, including bypass passages 26*c* and 26*d* are molded integrally from resin. This allows valve chambers 38 and 46, which may be formed integrally with vacuum manifold 50, to be friction or solvent welded to intake manifold 14. Those skilled in the art will appreciate however, that the present vacuum generator system could be configured as a single casting combining the vacuum generator with the throttle body and intake manifold.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. An internal combustion engine, comprising:

an intake manifold;

a throttle body having a main passage connected with said intake manifold, with said throttle body also having a throttle plate for controlling airflow through said main passage and said intake manifold;

a bypass passage having a first portion formed in said throttle body and a second portion formed integrally with said intake manifold;

a venturi formed in the second portion of the bypass passage, with said venturi having a vacuum passage extending into a vacuum manifold; and a direct vacuum supply passage extending from the second portion of the bypass passage into said vacuum manifold, wherein said intake manifold and said bypass passage are molded integrally into a first assembly, and said vacuum manifold, said venturi vacuum passage, and said direct vacuum supply passage are molded integrally as a second assembly, with said first assembly and second assembly being joined after molding, and with said engine further comprising a first check valve positioned in a valve chamber formed in the venturi vacuum passage between said venturi and said vacuum manifold, and a second check valve positioned in a valve chamber formed in the direct vacuum supply passage between the second portion of the bypass passage and the vacuum manifold.

2. An internal combustion engine according to claim 1, wherein said venturi is positioned in the second portion of the bypass passage between the first portion of the bypass passage and said direct vacuum supply passage.

3. An integral vacuum generator system for an internal combustion engine, comprising:

an intake manifold;

a throttle body having a main passage connected with said intake manifold, with said throttle body also having a throttle plate for controlling airflow through said main passage and said intake manifold;

a bypass passage having a first portion formed in said throttle body and a second portion formed integrally with said intake manifold;

a venturi formed in the second portion of the bypass passage, with said venturi having a vacuum passage extending into a vacuum manifold;

a direct vacuum supply passage extending from the second portion of the bypass passage into said vacuum manifold; and a first check valve positioned in the venturi vacuum passage between said venturi and said vacuum manifold, and a second check valve positioned in the direct vacuum supply passage between the second portion of the bypass passage and the vacuum manifold, with said first check valve and said second check valve being positioned such that said venture will provide vacuum to said vacuum manifold when said throttle plate is open and said second check valve is closed, with said direct vacuum supply passage providing vacuum to said vacuum manifold when said throttle and said first check valve are both closed, wherein said intake manifold and said bypass passage are molded integrally into a first assembly, and said vacuum manifold, said venturi vacuum passage, and said direct vacuum supply passage are molded integrally as a second assembly, with said first assembly and second assembly being joined after molding, and with said engine further comprising a first check valve positioned in a valve chamber formed in the venturi vacuum passage between said venturi and said vacuum manifold, and a second check valve positioned in a valve chamber formed in the direct vacuum supply passage between the second portion of the bypass passage and the vacuum manifold.

4. An internal combustion engine having an integral vacuum generator system, comprising:

an intake manifold;

a throttle body having a main passage connected with said intake manifold, with said throttle body also having a throttle plate for controlling airflow through said main passage and said intake manifold;

a bypass passage having a first portion formed in said throttle body and a second portion formed integrally with said intake manifold;

a venturi formed in the second portion of the bypass passage, with said venturi having a vacuum passage extending into a vacuum manifold;

a direct vacuum supply passage extending from the second portion of the bypass passage into said vacuum manifold; and a first check valve positioned in the venturi vacuum passage between said venturi and said vacuum manifold, and a second check valve positioned in the direct vacuum supply passage between the second portion of the bypass passage and the vacuum manifold, with said first check valve and said second check valve being positioned such that said venturi will provide vacuum to said vacuum manifold when said throttle plate is open and said second check valve is closed, with said direct vacuum supply passage providing vacuum to said vacuum manifold when said throttle and said first check valve are both closed, wherein said intake manifold and said bypass passage are molded integrally into a first assembly, and said vacuum manifold, said venturi vacuum passage, and said direct vacuum supply passage are molded integrally as a second assembly, with said first assembly and second assembly being joined after molding, and with said engine further comprising a first check valve positioned in a valve chamber formed in the venturi vacuum passage between said venturi and said vacuum manifold, and a second check valve positioned in a valve chamber formed in the direct vacuum supply passage between the second portion of the bypass passage and the vacuum manifold.

* * * * *